US005330248A

United States Patent [19]

Smyly et al.

[11] Patent Number: 5,330,248

[45] Date of Patent: Jul. 19, 1994

[54] FOLDABLE AND ADJUSTABLE DRAWING DESK

[75] Inventors: Susan V. Smyly; Suzanne Iannaccone, both of New York; John F. Wilson, Harrison, all of N.Y.

[73] Assignee: I.S. International, New York, N.Y.

[21] Appl. No.: 983,814

[22] Filed: Dec. 1, 1992

[51] Int. Cl.[5] ..... A47B 39/00

[52] U.S. Cl. ..... 297/174; 297/135; 297/440.1; 312/235.2; 312/231; 248/460

[58] Field of Search ..... 297/135, 170, 173, 174, 297/311, 440, 440.1, 440.22; 248/441.1, 460, 463; 312/235.2, 231, 230

[56] References Cited

U.S. PATENT DOCUMENTS

| | | | |
|---|---|---|---|
| 88,256 | 3/1969 | Bacon . | |
| D. 145,659 | 10/1946 | Covington . | |
| D. 182,061 | 2/1958 | Cote . | |
| 1,557,541 | 10/1925 | Lynch et al. . | |
| 1,619,381 | 3/1927 | Steward . | |
| 1,821,252 | 1/1931 | Woods . | |
| 1,877,669 | 9/1932 | Kitze . | |
| 2,497,360 | 2/1950 | Justice . | |
| 2,579,606 | 12/1951 | Oom et al. . | |
| 2,638,702 | 5/1953 | Holbrook . | |
| 2,918,107 | 12/1959 | Cote . | |
| 3,086,296 | 4/1963 | Bergstrom . | |
| 3,117,816 | 1/1964 | De Sena | 248/463 X |
| 3,244,450 | 4/1966 | Boutin . | |
| 3,399,925 | 9/1968 | Levy . | |
| 3,660,903 | 5/1972 | Caperton, Jr. . | |
| 3,907,360 | 9/1975 | Czarnowski . | |
| 4,036,465 | 7/1977 | Kellner | 248/463 |
| 4,057,244 | 11/1977 | Gaspar . | |
| 4,482,185 | 11/1984 | Zoellner | 297/135 |
| 4,790,506 | 12/1988 | Malinowski et al. | 248/441.1 |
| 4,798,411 | 1/1989 | Lin . | |
| 4,921,302 | 5/1990 | Godwin . | |
| 4,921,303 | 5/1990 | White . | |

FOREIGN PATENT DOCUMENTS

| | | | |
|---|---|---|---|
| 0675384 | 7/1952 | United Kingdom | 248/463 |

*Primary Examiner*—Kenneth J. Dorner
*Assistant Examiner*—Milton Nelson, Jr.
*Attorney, Agent, or Firm*—Leydig, Voit & Mayer, Ltd.

[57] ABSTRACT

A novel and improved drawing desk is provided which can be folded between a storage position and a drawing position. The desk has a center leg which raises from a first end located on the floor to a second end which is pivotally attached to an end leg. By pivotally attaching the center and end legs, the longitudinal axes of the center leg and end leg can be positioned so that they are substantially parallel in the storage position and substantially transverse in the drawing position. An easel is pivotally attached to the center leg for receiving a removable drawing board. A seat assembly, pivotally attached to the center leg, has a protruding seat arm adapted to engage a seat slot disposed in the center leg and a device for adjusting the position of the seat in order to accommodate users of different sizes. In the preferred embodiment, the adjusting device comprises the seat leg having a bottom end which is adapted to engage a plurality of openings disposed along the center leg. By aligning the longitudinal axes of the seat, the seat leg, the end leg, easel and the center leg in the storage position, the drawing desk is relatively compact so that numerous desks may be stored in a small area.

26 Claims, 4 Drawing Sheets

FIG. 1
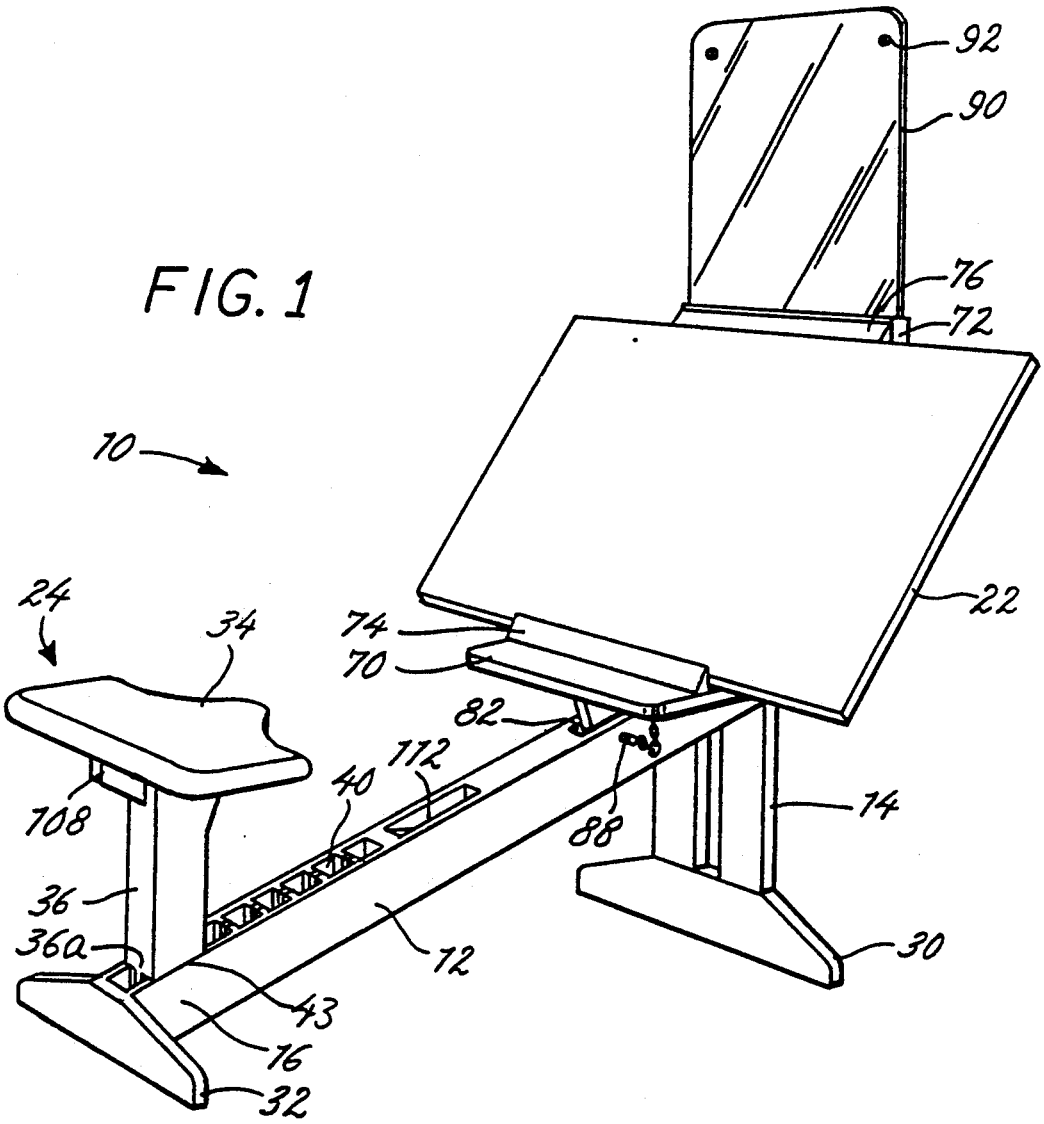
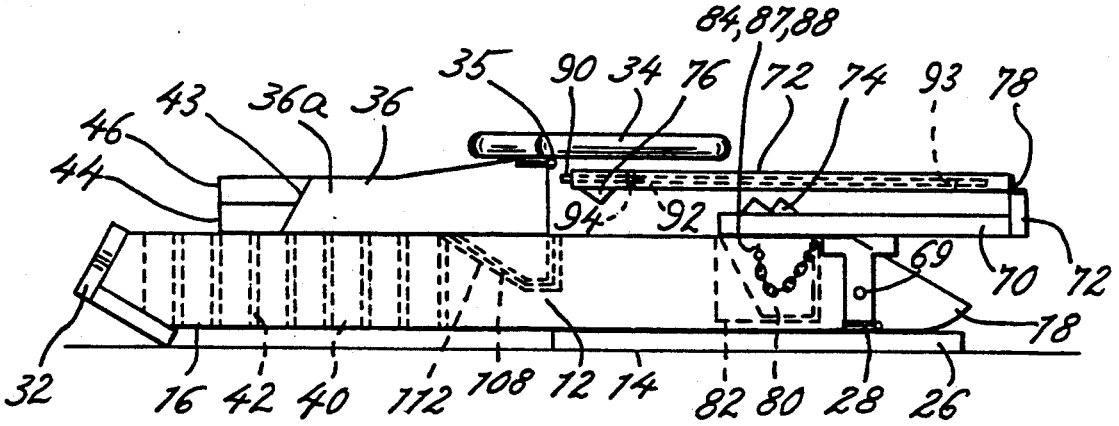
FIG. 3

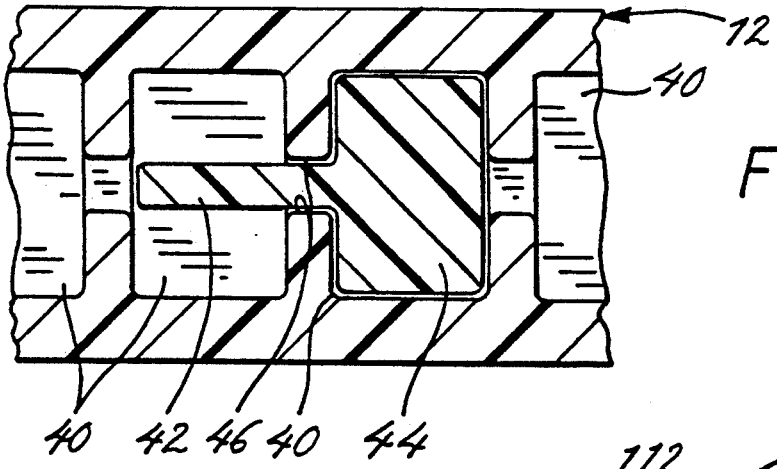
FIG. 4
FIG. 5
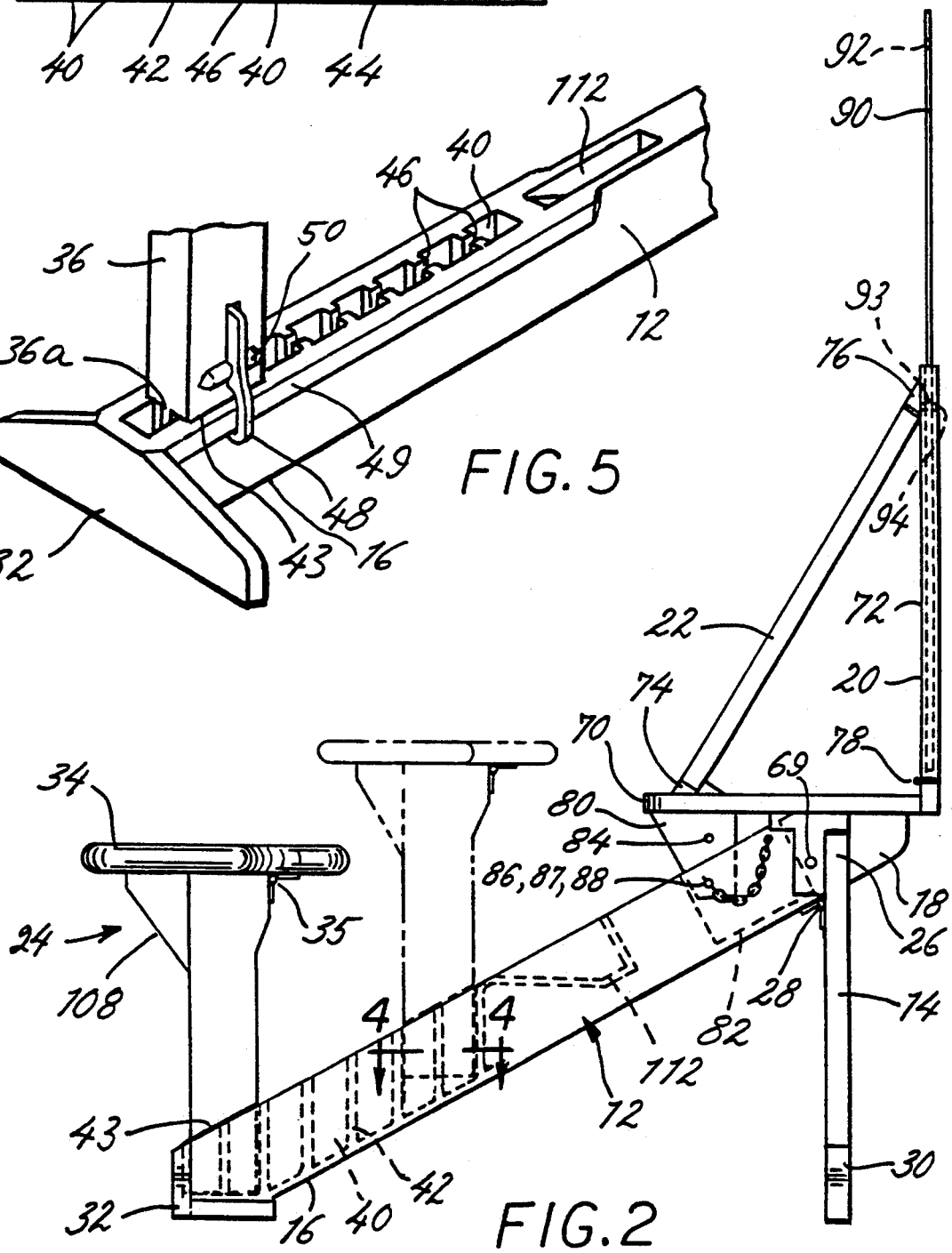
FIG. 2

FIG. 6
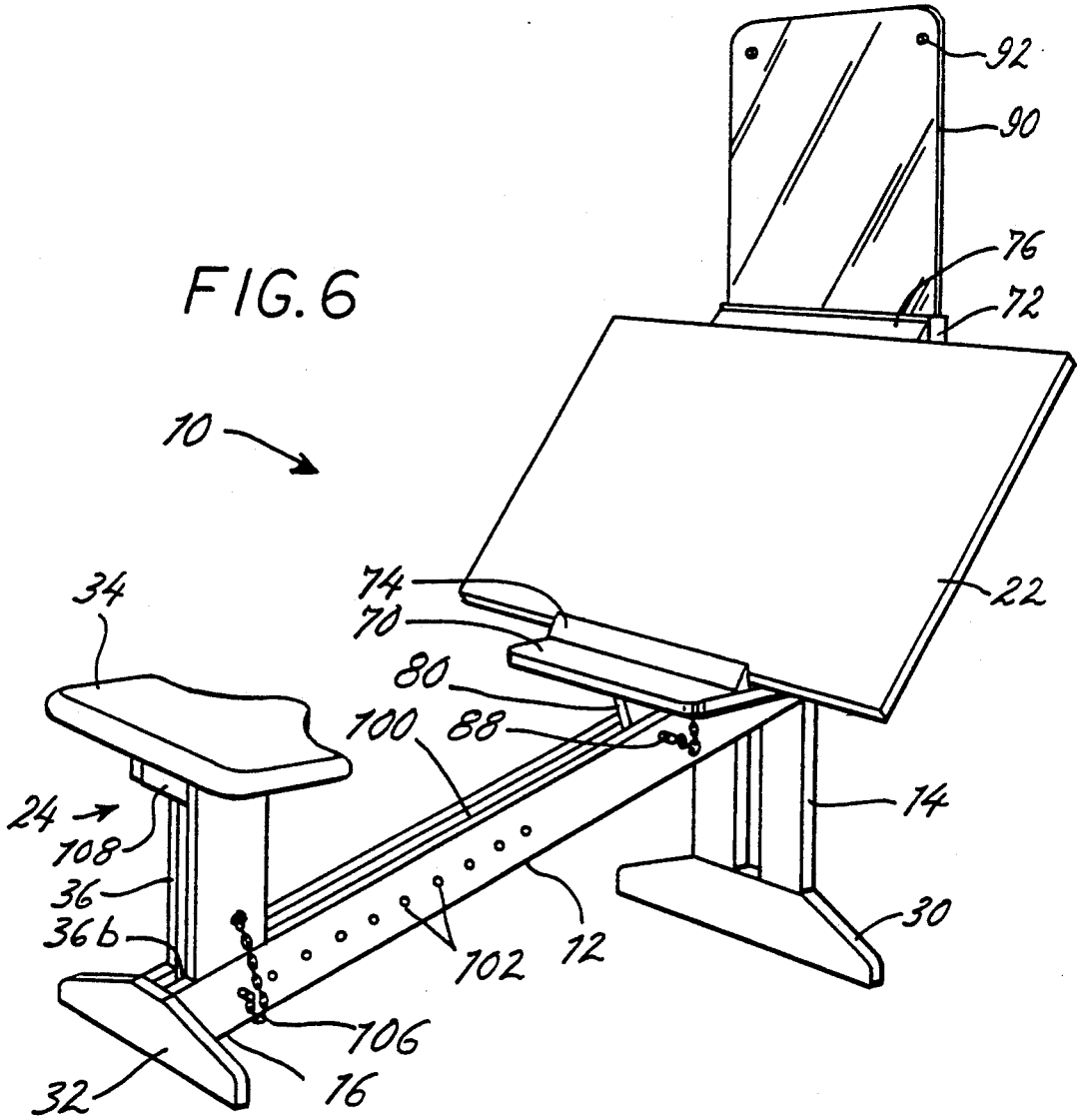
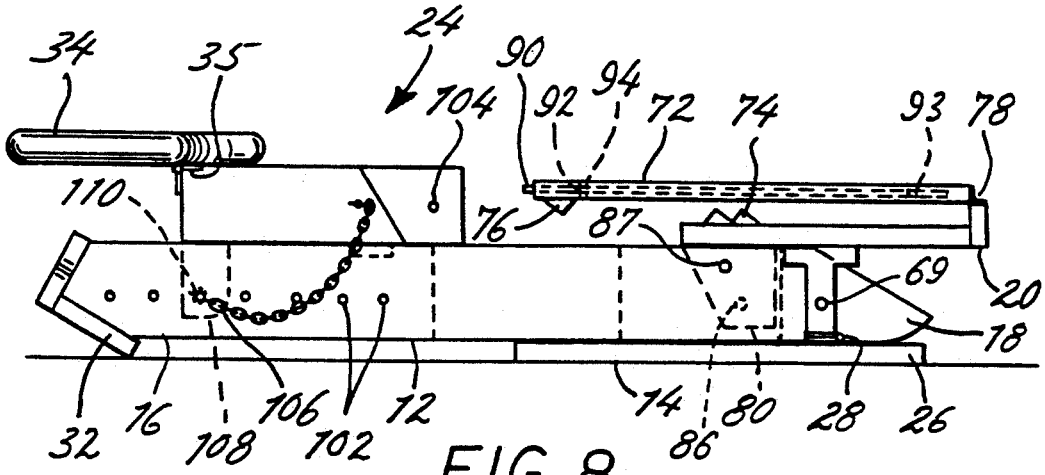
FIG. 8

FOLDABLE AND ADJUSTABLE DRAWING DESK

FIELD OF THE INVENTION

This invention relates generally to a drawing desk and more particularly to an adjustable foldable drawing desk.

BACKGROUND OF THE INVENTION

Conventional drawing desks and easels present several problems. First, in both classroom and commercial settings, it is significant that many drawing easels cannot be adjusted to accommodate users of different sizes. Unfortunately, in the relatively few easels which are adjustable, the adjustment mechanisms are complex, have numerous parts, and are difficult to assemble and use.

Furthermore, typical drawing easels are bulky and cumbersome units which are difficult for young students to carry and maneuver. It is also impractical to use bulky or cumbersome easels in environments such as crowded classrooms or offices where storage space is at a premium. Unfortunately, many conventional drawing easels which can be disassembled for storage purposes are complex devices with numerous parts and difficult to use, especially for young students.

Teaching students to draw can be a difficult task. One typical problem is teaching students correct posture and body orientation with respect to the object that is being drawn and with respect to the drawing medium, typically paper. It will be appreciated that students should keep an upright posture and maintain a constant orientation between their body, the easel, the object and the drawing paper. However, students, especially young students, tend to constantly shift their body position, thus changing their positional relationship with the object and the drawing paper.

Conventional drawing easels, which consist of an easel, a drawing board and a stool, only aggravate this problem. First, the student can easily change the orientation of the student's body, the object, the stool, and the drawing board. Typically, students will position the chair too close or too far from the drawing board. Second, these drawing easels are relatively uncomfortable, causing the student to shift orientation.

It is also difficult to teach young students to draw because they are unable to fully visualize form, proportion and perspective well enough to produce a finished product. The young student lacks the experience to appreciate the interaction between the lines of a three dimensional object and to reduce the object into basic elements to reproduce the object.

OBJECTS AND SUMMARY OF THE INVENTION

Accordingly, it is an object of the present invention to provide a foldable drawing desk.

Another object of the present invention is to provide a drawing desk which can be easily and quickly disassembled for storage. Similarly, the foldable drawing desk should be easily assembled.

A further object of the present invention is to provide a drawing desk which can be adjusted to accommodate users of different sizes.

Still a further object of the present invention is to provide a foldable drawing desk which will assist the user in maintaining the proper posture and body orientation with respect to the object and the drawing board.

Another object is to provide a drawing desk which assists students to draw a three dimensional object.

Accordingly, a novel and improved drawing desk is provided which can be folded between a storage position and a drawing position. The desk has a sturdy base formed by a center leg and an end leg. The center leg forms a diagonal ramp and which raises from a first end located on the floor to a second end which is pivotally attached to the end leg. By pivotally attaching the center and end legs, the longitudinal axes of the center leg and end leg can be positioned so that they are substantially parallel in the storage position and substantially transverse in the drawing position.

An easel having a platform and an upright portion for receiving a removable drawing board is attached to the center leg. The easel has means for pivoting the easel between the drawing and storage positions. The pivoting means has a hinge pivotally attaching the upright and platform portions, thereby permitting the longitudinal axes of the platform and upright portions to be positioned so that they are substantially transverse to each other in the drawing position and substantially parallel in the closed position.

The pivoting means also comprises an arm member projecting from the platform portion for slidably engaging the center leg and having first and second arm holes and the center leg having a leg hole which is adapted to align with the first and second arm holes. A peg can be inserted into the first arm hole and leg hole for retaining the easel in the storage position or into the second arm hole and the leg hole for retaining the easel in the drawing position.

A seat assembly, attached to the center leg, has a seat, a seat leg, a seat arm protruding from the seat leg and adapted to engage a slot disposed in the center leg, and means for adjusting the position of the seat in order to accommodate users of different sizes.

In the preferred embodiment, the adjusting means comprises the seat leg having a bottom end which is adapted to engage a plurality of openings disposed along the center leg. The vertical and horizontal positions of the seat can be simultaneously adjusted with respect to the easel by selectively inserting the bottom end of the seat leg into one of the openings.

In a second embodiment, the adjusting means comprises a seat leg having a bottom end adapted to slidably engage a center slot located along the diagonal ramp of the center leg. In order to maintain the seat assembly in the selected position, the bottom end of the seat leg has a seat hole which can be selectively aligned with a plurality of holes disposed along the center leg so that a peg can be inserted therein.

In order to store the seat assembly, the bottom end of the seat leg is disengaged from the center leg so that the seat arm is inserted into the slot disposed in the center leg. In the storage position, the longitudinal axes of the seat, seat leg and center leg are substantially parallel.

It will be appreciated that by aligning the longitudinal axes of the seat, the seat leg, the end leg, the desk platform portion, the upright portion, and the center leg, the drawing desk is relatively compact in the storage position so that numerous desks may be stored in a small area.

In accordance with another object, the desk can be easily and quickly assembled. In order to assemble the drawing desk, the end leg is pivoted from the storage position in which the longitudinal axes of the end leg and the center leg are substantially parallel to the drawing position in which the longitudinal axes are transverse to one another.

After the center leg and end leg form the base, the seat assembly is assembled. In the preferred embodiment, the arm member is removed from the center slot and the bottom end is selectively inserted into the opening which positions the seat at the desired distance from the easel and the drawing board. In the second embodiment, the seat leg is inserted into the center slot at the desired distance from the easel and the drawing board and secured by inserting the peg into the seat hole and leg hole.

The easel is assembled by disengaging the peg from the second arm hole and leg hole, pivoting the platform portion so that the first hole and the leg hole are aligned, and inserting the peg therein.

It will be appreciated that when the seat is positioned along the center leg, the relationship between the seat and the drawing board will be maintained, thereby assisting the user such as a young student to maintain the proper relationship between the user's body, the easel, the drawing board and the drawing paper.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a perspective view of the preferred embodiment of a foldable drawing desk made in accordance with the present invention in the open or drawing position;

FIG. 2 is a side elevational view of the foldable drawing desk illustrated in FIG. 1;

FIG. 3 is a side elevational view of the preferred embodiment of the foldable drawing desk in the closed or storage position;

FIG. 4 is an enlarged cross-sectional view taken along line 4—4 in FIG. 2;

FIG. 5 s a perspective view of the preferred embodiment of the present invention having a latch mechanism for holding the seat in the center leg;

FIG. 6 is a perspective view of a second embodiment of the foldable drawing desk made in accordance with the present invention in the open or drawing position;

FIG. 8 is a side elevational view of the second embodiment of the foldable drawing desk in the closed or storage position.

Figure 7:
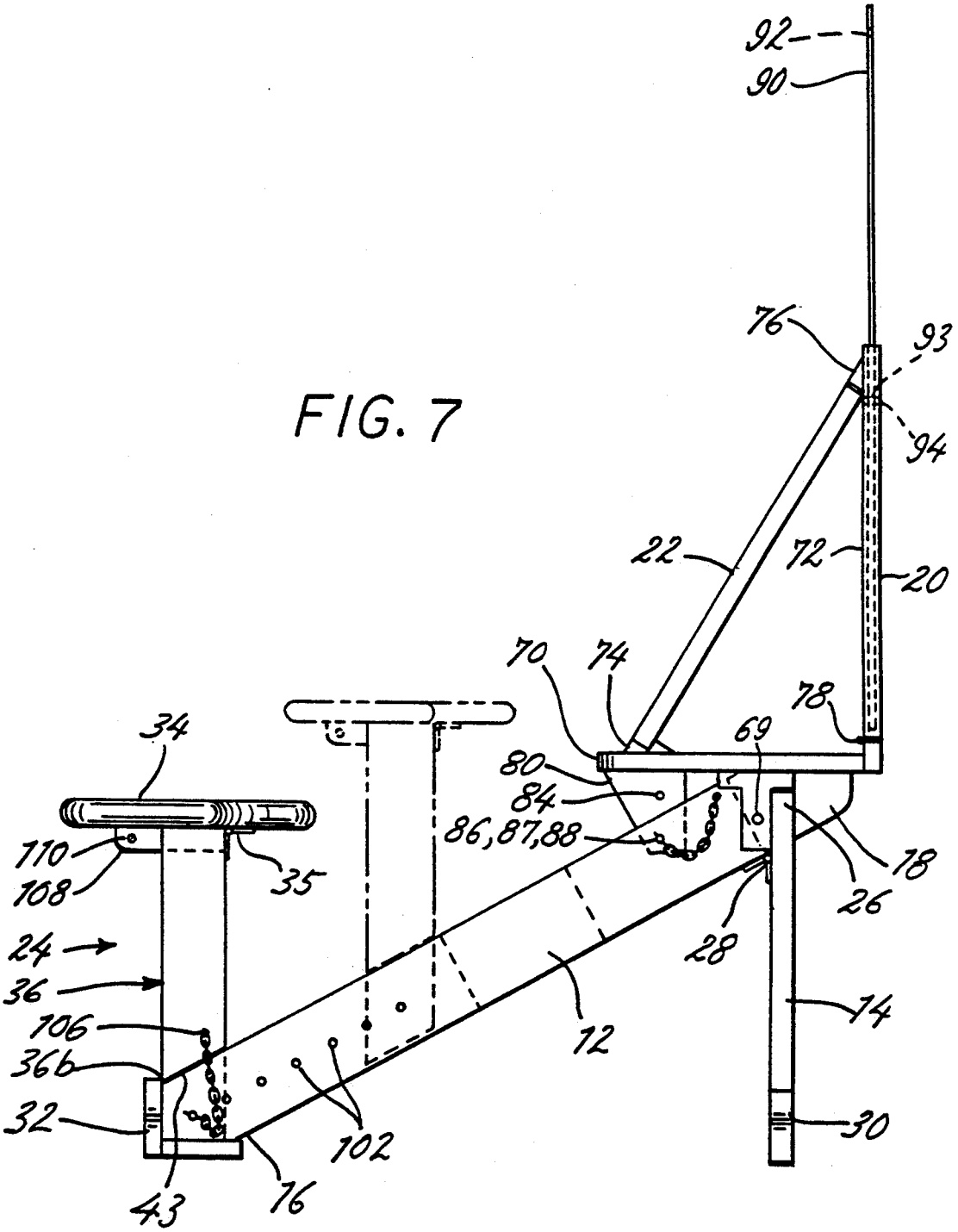
FIG. 7 is a side elevational view of the foldable drawing desk illustrated in FIG. 6.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Turning to the drawings, FIGS. 1–5 illustrate a first embodiment of a foldable desk 10 made in accordance with the present invention and FIGS. 6–8 illustrate a second embodiment of the invention. The foldable drawing desk 10 comprises a center leg 12 and an end leg 14 supporting a seat assembly 24 so that a person can sit at the desk 10 and draw an object (not shown). The drawing desk 10 has an easel 20 pivotally attached to the center leg 12 for receiving a drawing board 22. The foldable drawing desk 10 can be maneuvered between an open or a drawing position as shown in FIGS. 1–2 and 6–7 which permits a person to sit in the seat assembly 24 and draw an object on the drawing board 22 and a closed or storage position as shown in FIGS. 3 and 8 which permits the desk 10 to be easily stored or transported.

The center leg 12, which has a first end 16 and a second end 18, forms a diagonal ramp raising from the first end 16 located on the floor to the second end 18 supported by the end leg 14. The second end 18 of the center leg 12 is pivotally attached to the top end 26 of end leg 14.

In order to provide a sturdy platform so that a user can comfortably and stably sit in the seat assembly 24, the longitudinal axes of the center leg 12 and the end leg 14 are substantially transverse to each other so that the cross-sectional profile of the center leg 12 and the end leg 14 form a triangle with the floor as may be seen in FIGS. 1–2 and 6–7. In the illustrated embodiment, the end leg 14 is substantially perpendicular to the floor although, in other embodiments, it may make an acute or obtuse angle with the floor.

In order to further stabilize the desk 10, the center leg 12 and the end leg 14 have transverse base members 30, 32 which restrain the desk 10 from tilting sideways when the user is sitting in seat assembly 24. The longitudinal axes of the transverse base members 30, 32 are transverse, and preferably perpendicular, to longitudinal axis of the center leg 12 and end leg 14. The transverse base members 30, 32 can be attached to the center leg 12 by any conventional means including, for example, screws, nails, glue or any molding techniques.

In order to permit the center leg 12 and the end leg 14 to be positioned between the drawing and storage positions, the second end 18 of the center leg 12 is pivotally attached to the top end 26 of end leg 14 by a hinge 28. Hinge 28 of any conventional type including, for example, a lock hinge, can be easily locked to hold the legs 12, 14 in a desired position or unlocked to permit the legs 12, 14 to be pivoted with respect to each other. Lock hinge 28 permits the center leg 12 and end leg 14 to be pivoted between the drawing position (shown in FIGS. 1–2 and 6–7) in which the longitudinal axes of the center leg 12 and the end leg 14 are substantially transverse to each other and the storage position (shown in FIGS. 3 and 8) in which the longitudinal axes of the center leg 12 and the end leg 14 are substantially parallel to each other.

The L-shaped easel 20, which supports the drawing board 22 in a fixed positional relationship, is pivotally attached to the center leg 12 at pin 69. Easel 20 has a platform portion 70 for supporting one end of the drawing board 22 and an upright portion 72 for supporting the other end of the drawing board 22. In the preferred embodiment, the platform portion 70 is substantially parallel with the floor so that the user can place drawing materials and supplies thereon. Although, in the illustrated embodiments, the platform and upright portions 70, 72 have longitudinal axes which are substantially perpendicular to each other in the drawing position, it is not mandatory as long as they support the drawing board 22 between them. In order to provide additional support and prevent the drawing board 22 from sliding, the platform and upright portions 70, 72 may also have projections 74, 76 for engaging the edges of the drawing board 22.

In order to facilitate storing and transporting the drawing desk 10, means are provided for pivoting the easel 20 from the drawing position in FIGS. 1–2 and 6–7 to the storage position in FIGS. 3 and 8. In the illustrated embodiments, the pivoting means has a hinge 78 pivotally connecting the platform portion 70 and the upright portion 72 to each other, thereby permitting them to rotate from the drawing position in which the longitudinal axes of the platform and upright portions 70, 72 are transverse to each other (as shown in FIGS. 1–2 and 6–7) to the storage position in which the longitudinal axes of the platform and the upright portions 70, 72 are substantially parallel to each other (as shown in FIGS. 3 and 8).

The pivoting means also permits the platform portion 70 of the easel 20 to pivot with respect to the center leg 12 so that the longitudinal axes of the center leg 12 and the platform portion 70 are substantially parallel to each other as shown in FIGS. 3 and 8. Specifically, the pivoting means has an arm member 80 projecting from the platform portion 70 for slidably engaging easel slot 82 located in the center leg 12. The arm member 80 has first and second holes 4, 86 which are adapted to selectively align with leg hole 87 located in the center leg 12 as platform portion 70 pivots about pin 69 and the arm member 80 slides within easel slot 82. Referring to FIGS. 2 and 7, the first arm hole 84 can easily be seen. The second arm hole 86, and the leg hole 87 cannot be seen because the peg 88 is inserted therein and obscures the view of the holes. For illustrative purposes, FIG. 2 has been labelled with the references 86, 87 and 88 to indicate that the second arm hole 86, the leg holes 87 and the peg 88 are present at the same point. The peg 88 has been omitted from FIG. 8 to permit the leg hole 87 to be seen. When first arm hole 84 and second arm hole 86 are selectively aligned with leg hole 87, peg 88 can be selectively inserted into the aligned holes in order to maintain the easel 20 in either the storage or drawing positions, respectively. When peg 88 is removed, the easel 20 can be positioned between the storage and drawing positions. It will be appreciated that the arm member 80 may also be held in the storage or drawing positions by numerous other conventional means such as clips, latches and the like.

Any conventional drawing board 22 may be used with the desk 10. A typical drawing board 22 is a flat, generally rectangular, board for receiving drawing paper on its outside surface. Another type of drawing board (not shown) may have an internal compartment for holding sheets of drawing paper and other drawing materials such as pencils, pencil boxes, erasers and the like.

It will be appreciated that a drawer will want to be approximately arm-length from the drawing board 22 and slightly higher than the top of the drawing board 22 to obtain a full view of the object. Thus, users will want to adjust the vertical and horizontal distance of the seat 34 with respect to the easel 20 and the drawing board 22 depending upon their size. For example, a large person will have to be further away from the easel 20 and drawing board 22 than a small person. Unfortunately, many conventional foldable drawing desks do not permit the vertical and horizontal position of the seat 34 with respect to the drawing board 22 to be simultaneously adjusted.

In accordance with one of the objects of the present invention, the drawing desk 10 has a seat assembly 24 which can be adjusted in order to accommodate people of different sizes who are using the drawing desk 10. The seat assembly 24 is a T-like member having a seat 34 pivotally attached to a lower seat leg 36 at hinge 35. In order to accommodate people of different sizes, means is provided for simultaneously adjusting the position of the vertical and horizontal position of the seat 34 relative to the drawing board.

In the preferred embodiment illustrated in FIGS. 1–5, the adjusting means comprises a plurality of openings 40 disposed along the length of the ramp portion of the center leg 12 and adapted to selectively receive the seat leg 36 to hold the seat 34 in a selected position. The top end of the openings 40 should be open to receive the seat leg 36. The bottom end of the openings 40 may be open or closed as long as the seat leg 36 fits within the openings 40. It will be appreciated that the opening 40 may have any desired cross-sectional shape. In the preferred embodiment illustrated in FIG. 4, each opening 40 is generally rectangular in shape. A relatively narrow slot 42 connects each adjacent opening 40. The openings 40 pass through substantially the entire width of the center leg 12 and are oriented to keep the seat 34 substantially parallel with the floor. For example, the openings 40 in the illustrated embodiment are substantially perpendicular to the floor but may have a different orientation if the seat assembly 24 is designed accordingly to maintain the seat 34 substantially parallel to the floor.

It will be appreciated that the bottom end **36*a* of the seat leg 36 must be adapted to engage the openings 40 and to securely retain the seat assembly 24 in the desired position. In the preferred embodiment illustrated in FIG. 4, the bottom end 36*a* of the seat leg 36 has a rectangular portion 44 and a projecting portion 46 which are adapted to firmly engage opening 40 and slot 42, respectively. In order to engage the openings 40, the cross-sectional shape of the lower end of the seat leg 36 should be slightly smaller than the openings 40. It has been found that six openings 40 at $1\frac{1}{2}$ inch increments yielding approximately a $\frac{3}{4}$ inch vertical rise for each opening 40 and a total vertical rise of $4\frac{1}{2}$ inches will meet most ergonomic needs. The adjusting means provides a more efficient distribution of the weight of the drawer due to the greater surface area presented by the rectangular portion 44 and projecting portion 46 and minimizes the wear on the openings 40 in the center leg 12. The bottom end 36*a* also has an edge 43 which engages the top of the center leg 12 to distribute the weight of the user on the seat assembly 24. It will also be appreciated that the bottom end 36*a* may be adapted to engage any number of openings 40 or slots 42**.

The seat leg 36 may have a means for latching the seat leg 36 to the center leg 12. FIG. 5 illustrates the latching means comprising a hook 48 pivotally attached to the bottom end **36*a* of the seat leg 36 at pin 50 and adapted to hook a projecting edge 49 disposed along the center leg 12**.

In another embodiment illustrated in FIGS. 6–8, the adjusting means comprises a peg and hole system. The center leg 12 has a center slot 100 disposed along its longitudinal axis for receiving the seat leg 36 and a plurality of leg holes 102 located along the length of the center leg 12 and disposed along the transverse axis of the center leg 12. In this embodiment, the bottom end **36*b* of the seat leg 36 is adapted to slidably engage the center leg slot 100 and has a seat hole 104 which can be selectively aligned with the leg holes 102 as the bottom end 36b slides within the center leg slot 100. A peg 106 can be inserted and removed from an aligned leg hole 102 and the seat hole 104**.

In order to position the seat 24 at the desired position, the bottom end 36b of the seat leg 36 is inserted into the center slot 100, the seat hole 104 and leg hole 102 are aligned at the desired position, and peg 106 is inserted into the aligned seat hole 104 and the leg hole 102 thereby maintaining the seat assembly 24 in the desired position.

It should now be apparent that the adjusting means permits the vertical and horizontal positions of the seat assembly 24 to be adjusted with respect to the easel 20 and the drawing board 22 so that a small person can be closer to the drawing board whereas a large person can be further away from the drawing board 22. As the seat assembly 24 is positioned along the ramp portion of the center leg 12, the vertical and horizontal positions of the seat assembly 24 with respect to the easel 20 and drawing board 22 are simultaneously adjusted so that people of different sizes will be positioned properly with respect to the easel 20 and drawing board 22, i.e., approximately at arm-length and eye level.

In accordance with one of the objects of the present invention, a storable viewing window 90 can be provided which would assist the student drawer in learning to visualize form, proportion and perspective, to appreciate the interaction between the lines of a three-dimensional object, and to reduce the object into basic elements to reproduce the object.

In order to use the viewing window, the user aligns the desk 10 so that the object to be drawn is visible through the window 90. The window 90 acts as a consistent reference point for the three dimensional object so that the beginner drawer can study the interrelationship between the lines and elements of the object. The position of the window 90 with respect to the drawer and the object remains constant so that the drawer can place a ruler or a straight edge, such as a pencil, along the surface of the window 90 and measure the orientation and size of the elements of the object. Without the window 90, the student has to estimate the orientation and size of the object with respect to a consistent reference point. Many students have found this to be difficult and ineffective.

The viewing window 90 is a relatively thin section of transparent material, such as plastic, slidably disposed on the upright portion 72 of the easel 20. In the illustrated embodiments, the window 90 can be stored inside the upright portion 72 in the storage position (as shown in FIGS. 3 and 8) and extended in the drawing position (as shown in FIGS. 1–2 and 6–7). Means is provided for holding the viewing window 90 in the storage or drawing position. The holding means comprises a peg and hole system having a plurality of window holes 92, 93 located near the top and bottom of the viewing window 90, associated easel holes 94 located near the top end of the upright portion 72 which can be aligned with either the top window holes 92 or the bottom window holes 93, and a peg 92 which can fit into the window holes 92, 93 and the easel holes 94 when they are properly aligned. It will be appreciated that the viewing window 90 may also be held in the storage or drawing positions by numerous other conventional means such as clips, latches and the like.

In order to hold the viewing window 90 in the storage position as shown in FIGS. 3 and 8, the window 90 is positioned so that the top window holes 92 are aligned with the easel holes 94. Peg 96 is then inserted into the top window hole 92 and the easel hole 94 thereby holding the window 90 in the storage position and preventing the window 90 from sliding during transportation. Similarly, in order to hold the viewing window 90 in the open or drawing position as shown in FIGS. 1–2 and 6–7, the bottom window holes 93 are aligned with easel holes 94 so that when the peg 96 is inserted into the bottom window holes 93 and easel holes 94, the viewing window 90 is held in the drawing position.

In accordance with one of the objects, the foldable drawing desk 10 can be quickly and easily folded from the drawing position shown in FIGS. 1–2 and 6–7 to the storage position shown in FIGS. 3 and 8. In order to store or transport the desk 10, the seat assembly 24 has a seat arm 108 which is outwardly disposed at the top end of the seat leg 36 and which projects from the seat leg 36. Turning first to the preferred embodiment shown in FIGS. 1–5, the seat assembly 24 is removed from the center leg 12 by disengaging the bottom end 36a of the seat leg 36 from the openings 40 in the center leg 12. The seat 34 is pivoted about hinge 35 so that the longitudinal axes of the seat 34 and the seat leg 36 are substantially parallel thereby providing sufficient clearance between the seat 34 and the center leg 12. The seat arm 108 of the seat assembly 24 is then inserted into the seat slot 112 of the center leg 12. In this storage position, the longitudinal axes of the seat 34, seat leg 36 and center leg 12 are substantially parallel.

The drawing easel 20 can be folded to the storage position by removing the peg 88 from the second arm hole 86 of the arm member 80 and the leg hole 87, thereby permitting the easel 20 to be pivoted so that the first arm hole 84 and the leg hole 87 are aligned. When they are aligned, the peg 88 can be inserted therein to hold the easel 20 in the storage position. In the storage position the longitudinal axes of the center leg 12, the platform portion 70 and the upright portion 72 are substantially parallel with each other.

In order to close the end leg 14, the end leg 14 is pivoted about hinge 28 so that the longitudinal axis of end leg 14 and the center leg 12 are substantially parallel with each other.

The second embodiment illustrated in FIGS. 6–8 is folded from the drawing position to the storage position in the same manner as the preferred embodiment except that the seat assembly 24 is removed from the center leg 12 by withdrawing the seat peg 106 from the seat hole 104 and the leg hole 102. The seat arm 108 is inserted into center slot 100 so that arm hole 110 aligns with one of the leg holes 102. Peg 106 is inserted into arm hole 110 and leg hole 102 thereby holding the seat 24 in the storage position.

It will now be appreciated that by aligning the longitudinal axes of the seat 34, the seat leg 36, the end leg 14, the desk platform portion 70, the upright portion 72 and the center leg 12, the drawing desk 10 is relatively compact in the storage position so that numerous desks may be stored in a small area.

In accordance with another object, the desk 10 can be easily and quickly assembled. In order to assemble the drawing desk 10, the end leg 14 is pivoted from the storage position in which the longitudinal axes of the end leg 14 and the center leg 12 are substantially parallel (as shown in FIGS. 3 and 8) to the drawing position in which the longitudinal axes are transverse to one another (as shown in FIGS. 1–2 and 6–7).

After the center leg 12 and end leg 14 form the base, the seat assembly 24 is assembled. In the preferred embodiment, the arm member 108 is removed from the seat slot 112 and the bottom end 36*a* is selectively inserted into the opening 40 which positions the seat 34 at the desired distance from the easel 20 and the drawing board 22. In the second embodiment, the seat leg 36 is removed from the center leg 12 by pulling the peg 106 out from the leg hole 102 and the arm hole 110. The seat leg 36 is inserted into center slot 100 so that the seat 34 is at the desired distance from the easel 20 and the drawing board 22. Once the seat hole 104 is aligned with the desired leg hole 102, the peg 106 is inserted therein, thereby maintaining the seat assembly 24 in the desired position.

The easel 20 is assembled by withdrawing the peg 88 from the second arm hole 86 and the leg hole 87, thereby permitting the first arm hole 84 to be aligned with the leg hole 87. The peg 88 is then inserted into the first arm hole 84 and leg hole 87 to retain the easel 20 in the drawing position.

From the foregoing description, it will now be appreciated that the desk may be quickly and easily dismantled or installed so that even relatively young children may use the desk without adult supervision.

We claim as our invention:

1. An adjustable foldable desk having a storage position for storage and transportation and a drawing position for use by a drawer to draw an object, the desk comprising:

a center leg having a longitudinal axis and first and second ends;

an end leg having a longitudinal axis which is pivotally attached to the second end of the center leg so that the end leg can be pivoted with respect to the center leg between the drawing position in which the longitudinal axes of the end and center legs are transverse to each other and the storage position in which the longitudinal axes of the end and center legs are substantially parallel to each other;

an easel for holding a drawing board having a longitudinal axis is pivotally attached to the center leg so that the easel can be pivoted with respect to the center leg between the drawing position in which the longitudinal axes of the center leg and the easel are transverse and the storage position in which the longitudinal axis of the center leg and easel are substantially parallel;

a seat assembly selectively attached to the center leg; and means for selectively adjusting the position of the seat assembly with respect to the easel along said center leg, wherein said adjustment includes both horizontal and vertical adjustment of said seat assembly with respect to said easel.

2. The invention according to claim 1 wherein the adjusting means comprises the seat assembly having a bottom end and the center leg having a plurality of openings disposed along its length for selectively receiving and holding the bottom end of the seat assembly in the desired position.

3. The invention according to claim 2 wherein the openings are connected by a slot and the bottom end of the seat leg is adapted to engage one of the openings and the slot.

4. The invention according to claim 2 wherein the center leg has an edge disposed along its length, the seat assembly has a latch for housing the edge for retaining the seat assembly at the selected position.

5. The invention according to claim 2 wherein the easel has platform and upright portions for holding the drawing board therebetween, each portion having a longitudinal axis, the platform and upright portions are pivotally attached to each other so that the platform and upright portions can be pivoted between the drawing position in which the longitudinal axes of the platform and upright portions are transverse to each other and the storage position in which the longitudinal axes of the platform and upright portions are substantially parallel to each other, and the platform portion is pivotally attached to the center leg so that the platform portion can be pivoted between the drawing position in which the longitudinal axes of the platform portion and the center leg are transverse to each other and the storage position in which the longitudinal axes of the platform portion and the center leg are substantially parallel to each other.

6. The invention according to claim 5 wherein the platform portion of the easel has an arm member projecting therefrom for slidably engaging the center leg, the arm member having first and second arm holes, the center leg has a leg hole for selectively aligning with the first and second arm holes, and a peg for inserting into the first arm hole and leg hole for holding the platform portion in the drawing position and for inserting into the second arm hole and leg hole for holding the platform portion in the storage position.

7. The invention according to claim 2 wherein the easel has platform and upright portions for receiving therebetween a drawing board for receiving and holding paper.

8. The invention according to claim 7 wherein the platform portion is substantially parallel to the floor in the drawing position.

9. The invention according to claim 2 wherein the easel has a top end having a slot for slidably receiving a transparent viewing window and window holding means for holding the viewing window in the storage position within the slot and in the drawing position for viewing the object through the viewing window.

10. The invention according to claim 9 wherein the window holding means comprises the viewing window having top and bottom ends and a plurality of holes disposed at the top and bottom ends of the viewing window, the easel having easel holes located near the top end for selectively aligning with the top and bottom window holes, and a peg for inserting into the bottom window holes and easel holes for retaining the viewing window in the drawing position and into the top window holes and easel holes for retaining the viewing window in the storage position.

11. The invention according to claim 2 wherein the seat assembly has an arm member projecting therefrom and a longitudinal axis and the center leg has a seat slot for receiving he arm member in the storage position so that the longitudinal axes of the center leg and seat assembly are substantially parallel in the storage position.

12. The invention according to claim 11 wherein the seat assembly has a seat and a seat leg having longitudinal axes, and the seat and seat leg are pivotally attached to each other so that the seat can be pivoted with respect to the seat leg between he drawing position in which the longitudinal axes of the seat and seat leg are transverse and the storage position in which the longitudinal axes of the seat and seat leg are substantially parallel to each other.

13. The invention according to claim 2 wherein the easel has an arm member projecting therefrom for slidably engaging the center leg, the arm member having first and second arm holes, the center leg has a leg hole for selectively aligning with the first and second arm holes, and a peg for inserting into the first arm hole and leg hole for holding the easel in the drawing position and for inserting into the second arm hole and leg hole for holding the easel in the storage position.

14. The invention according to claim 13 wherein the openings are connected by a slot and the bottom end of the seat leg is adapted to engage one of the openings and the slot.

15. The invention according to claim 13 wherein the center leg has an edge disposed along its length, the seat assembly has a latch for housing the edge for retaining the seat assembly at the selected position.

16. The invention according to claim 1 wherein the adjusting means comprises the seat assembly having a bottom end and a seat hole disposed on the bottom end, the center leg having a center slot disposed along its length for slidably receiving the bottom end of the seat assembly and a plurality of leg holes disposed along the length for selectively aligning with the seat hole when the bottom end slidably engages the center slot, and a peg for inserting into the eat hole and the leg holes for holding the seat assembly in the desired position.

17. The invention according to claim 16 wherein the easel has an arm member projecting therefrom for slidably engaging the center leg, the arm member having first and second arm holes, the center leg has a leg hole for selectively aligning with the first and second arm holes, and a peg for inserting into the first arm hole and leg hole for holding the easel in the drawing position and for inserting into the second arm hole and leg hole for holding the easel in the storage position.

18. The invention according to claim 16 wherein the easel has platform and upright portions for holding the drawing board therebetween, each portion having a longitudinal axis, the platform and upright portions are pivotally attached to each other so that the platform and upright portions can be pivoted between the drawing position in which the longitudinal axes of the platform and upright portions are transverse to each other and the storage position in which the longitudinal axes of the platform and upright portions are substantially parallel to each other, and the platform portion is pivotally attached to the center leg so that the platform portion can be pivoted between the drawing position in which the longitudinal axes of the platform portion and the center leg are transverse to each other and the storage position in which the longitudinal axes of the platform portion and the center leg are substantially parallel to each other.

19. The invention according to claim 18 wherein the platform portion of the easel has an arm member projecting therefrom for slidably engaging the center leg, the arm member having first and second arm holes, the center leg has a leg hole for selectively aligning with the first and second arm holes, and a peg for inserting into the first arm hole and leg hole for holding the platform portion in the drawing position and for inserting into the second arm hole and leg hole for holding the platform portion in the storage position.

20. The invention according to claim 14 wherein the easel has a top end having a slot for slidably receiving a transparent viewing window and window holding means for holding the viewing window in the storage position within the slot and in the drawing position for viewing the object through the viewing window.

21. The invention according to claim 20 wherein the window holding means comprises the viewing window having top and bottom ends and a plurality of holes disposed at the top and bottom ends of the viewing window, the easel having easel holes located near the top end for selectively aligning with the top and bottom window holes, and a peg for inserting into the bottom window hole an easel holes for retaining the viewing window in the drawing position and into the top window holes and easel holes for retaining the viewing window in the storage position.

22. The invention according to claim 16 wherein the easel has platform and upright portions for receiving therebetween a drawing board for receiving and holding paper.

23. The invention according to claim 22 wherein the platform portion is substantially perpendicular to the upright portion in the drawing position.

24. The invention according to claim 16 wherein the seat assembly has an arm member projecting therefrom and a longitudinal axis and the center slot receives the arm member in the storage position so that the longitudinal axes of the center leg and seat assembly are substantially parallel in the storage position.

25. The invention according to claim 24 wherein the seat assembly has a seat and a seat leg having longitudinal axes, and the seat and seat leg are pivotally attached to each other so that the seat can be pivoted with respect to the seat leg between the drawing position in which the longitudinal axes of the seat and seat leg are transverse and the storage position in which the longitudinal axes of the seat and seat leg are substantially parallel to each other.

26. An adjustable foldable desk having a storage position for storage and transportation and a drawing position for use by a drawer to draw an object, the desk comprising:

a center leg having a longitudinal axes and first and second ends;

an end leg having a longitudinal axis which is pivotally attached to the second end of the center leg so that the end leg can be pivoted with respect to the center leg between the drawing position in which the longitudinal axes of the end and center legs are transverse to each other and the storage position in which the longitudinal axes of the end and center legs are substantially parallel to each other;

an easel for holding a drawing board having a longitudinal axis is pivotally attached to the enter leg so that he easel can be pivoted with respect to the center leg between the drawing position in which the longitudinal axes of the center leg and the easel are transverse and the storage position in which the longitudinal axis of the center leg and easel are substantially parallel;

a seat assembly selectively attached to the center leg; and mean for selectively adjusting the position of the seat assembly with respect to the easel, wherein sad adjusting means comprises the seat assembly having a bottom end and the center leg having a plurality of openings disposed along its length for selectively receiving and holding the bottom end of the seat assembly in the desired position.

* * * * *